US011536055B2

(12) United States Patent
Strathmann et al.

(10) Patent No.: US 11,536,055 B2
(45) Date of Patent: Dec. 27, 2022

(54) CLOSING DEVICE FOR A MOTOR VEHICLE

(71) Applicant: Kiekert AG, Heiligenhaus (DE)

(72) Inventors: Michael Strathmann, Velbert (DE); Rolf Siemensmeyer, Moers (DE)

(73) Assignee: Kiekert AG, Heiligenhaus (DE)

( * ) Notice: Subject to any disclaimer, the term of this patent is extended or adjusted under 35 U.S.C. 154(b) by 592 days.

(21) Appl. No.: 16/472,230

(22) PCT Filed: Dec. 8, 2017

(86) PCT No.: PCT/DE2017/101048
§ 371 (c)(1),
(2) Date: Jun. 21, 2019

(87) PCT Pub. No.: WO2018/113829
PCT Pub. Date: Jun. 28, 2018

(65) Prior Publication Data

US 2020/0386013 A1 Dec. 10, 2020

(30) Foreign Application Priority Data

Dec. 21, 2016 (DE) ..... 10 2016 125 167.4

(51) Int. Cl.
*E05B 77/04* (2014.01)
*E05B 83/36* (2014.01)
*E05B 85/26* (2014.01)

(52) U.S. Cl.
CPC ..... *E05B 77/04* (2013.01); *E05B 83/36* (2013.01); *E05B 85/26* (2013.01); *E05Y 2900/531* (2013.01)

(58) Field of Classification Search
CPC ..... E05B 77/02; E05B 77/04; E05B 77/06; E05B 77/10; E05B 77/12; E05B 77/245;
(Continued)

(56) References Cited

U.S. PATENT DOCUMENTS 3,334,934 A * 8/1967 Sandor ..... E05B 85/243 292/216
4,382,622 A * 5/1983 Ishikawa ..... E05B 77/12 292/216
(Continued)

FOREIGN PATENT DOCUMENTS

CN 104047481 A 9/2014
CN 105464993 A 4/2016
(Continued)

OTHER PUBLICATIONS

Translation of First Office Action dated Jun. 3, 2020 for Chinese Application No. 2017800841969.
(Continued)

*Primary Examiner* — Kristina R Fulton
*Assistant Examiner* — Noah Horowitz
(74) *Attorney, Agent, or Firm* — Renner, Otto, Boisselle & Sklar, LLP

(57) ABSTRACT

A closing device for a motor vehicle includes a locking mechanism having a rotary latch and at least one pawl, a trigger lever, with the locking mechanism being unlocked by the trigger lever, and a blocking component which is arranged on the closing device for blocking a movement of the trigger lever when a load acts on the motor vehicle from the outside. The blocking component can be guided in the closing device in a movable manner.

19 Claims, 2 Drawing Sheets

Figure 1:
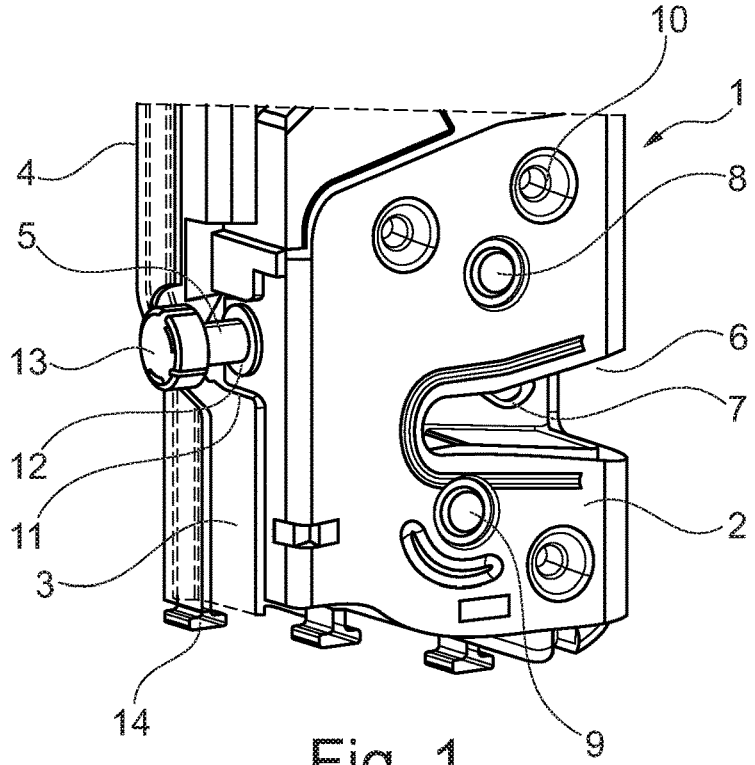

(58) Field of Classification Search
CPC ..... E05B 77/34; E05B 77/54; E05B 85/20; E05B 85/24; E05B 85/243; E05B 85/26; Y10T 292/1047; Y10T 292/1082; Y10S 292/22; Y10S 292/23; Y10S 292/61; Y10S 292/65
See application file for complete search history.

(56) References Cited

U.S. PATENT DOCUMENTS

| | | | | |
|---|---|---|---|---|
| 7,648,192 | B2 * | 1/2010 | Herline | E05B 77/04 296/187.12 |
| 8,449,003 | B2 * | 5/2013 | Bunker, II | E05B 63/006 292/336.3 |
| 8,701,817 | B2 * | 4/2014 | Schoen | E05B 77/04 180/281 |
| 8,727,402 | B2 * | 5/2014 | Bejune | E05B 85/16 292/336.3 |
| 9,534,424 | B2 * | 1/2017 | Bendel | E05B 77/06 |
| 9,689,183 | B2 * | 6/2017 | Ito | E05B 85/22 |
| 10,196,842 | B2 * | 2/2019 | Da Deppo | E05B 85/06 |
| 10,287,805 | B2 * | 5/2019 | Faust | E05B 77/04 |
| 11,060,326 | B2 * | 7/2021 | Fraley | E05B 77/06 |
| 2006/0261603 | A1 | 11/2006 | Cetnar et al. | |
| 2010/0109350 | A1 * | 5/2010 | Gschweng | E05B 77/44 292/196 |
| 2014/0312632 | A1 | 10/2014 | Nagaoka et al. | |
| 2016/0053516 | A1 * | 2/2016 | Schoch | E05B 85/22 292/138 |
| 2016/0168882 | A1 * | 6/2016 | Chung | E05B 79/20 292/92 |

FOREIGN PATENT DOCUMENTS

| | | | |
|---|---|---|---|
| DE | 102008021158 | A1 | 10/2009 |
| DE | 102011015675 | A1 | 10/2012 |
| DE | 202013002811 | U1 | 3/2014 |

OTHER PUBLICATIONS

International Search Report and Written Opinion for corresponding Patent Application No. PCT/DE2017/101048 dated Mar. 28, 2018.

* cited by examiner

CLOSING DEVICE FOR A MOTOR VEHICLE

DESCRIPTION

The invention relates to a closing device for a motor vehicle having a locking mechanism consisting of a rotary latch and at least one pawl and a trigger lever, wherein the locking mechanism can be unlocked the trigger lever, and means which are arranged on the closing device for blocking a movement of the trigger lever. The movement can be blocked by a load acting on the motor vehicle from the outside and a movement of the means for blocking.

In today's motor vehicles, functions which offer a high degree of comfort play a major role on the one hand and, on the other hand, an increasing number of safety-relevant functions are integrated into the vehicle in order to protect the vehicle occupants, for example, in the event of an accident. Thus it is necessary to ensure that the doors or flaps do not open automatically in the event of an accident. In the event of a side impact, inertia-related or impulse-related movements of the external door handles, for example, may result in the unlocking of the closing device assigned to the door and the opening of the door. There are various safety means which are known to protect against such accidental movements.

DE 20 2013 002 811 U1 creates awareness of a crash safety device, where a crash element is attached to an area of engagement, particularly a door skin, and whereby the crash element is accommodated in a movable manner along the longitudinal axis in a crash element storage. If, for example, a collision leads to a load acting on the motor vehicle, the crash element with the door skin can be moved longitudinally in the direction of a closing device. By moving the crash element, an actuation arrangement for unlocking the locking mechanism can then be blocked, so that an unintentional opening of the locking mechanism can be prevented. However, the disadvantage of such embodiments of longitudinally movable crash elements is that the crash element is to be aligned very precisely with respect to the closing device as, otherwise, although the crash element can be moved, the engagement cannot engage in the actuation arrangement or lever chain for triggering the locking mechanism. Thus, although the crash element could be moved, an actuation of the lever arrangement could not be prevented.

DE 10 2008 021 158 A1 creates awareness of a locking and closing device which ensures the securing of a vehicle door in the event of an impact. If, as a result of a load acting on the motor vehicle, such as in the case of a side impact, for example, on a lateral door and thus indirectly on the locking and closing device, the surface area, which is usually made of a thin metal sheet, is dented. By pressing, a locking or actuating means is moved against the force of a coil spring, so that a Bowden cable can be blocked.

In another innovative crash safety device, the closing device itself is provided with a blocking lever. The blocking lever swivelably arranged on the lock or the closing device has an initiating arm on one side. The initiating arm extends from the lock in the direction of the load acting on the motor vehicle, that is, in the direction of the door's outer panel. On the side facing the lock, the blocking lever has blocking legs that have a recess. In a normal actuation of the motor vehicle lock, a trigger lever swivels in the recess between the blocking legs. If, for example, a side impact exerts a load on the motor vehicle door, the initiating arm can be moved, whereby the blocking lever performs a swivel movement. The swivel movement results in one of the blocking legs being moved in the swivel range of the trigger lever, so that the trigger lever can be blocked in its movement. This prevents the locking mechanism from being unlocked by means of the trigger lever.

The object of the invention is to provide an improved lock for a motor vehicle. Furthermore, it is the object of the invention to provide an improved crash safety device which can ensure a reliable blocking. Another object of the invention is to provide a constructively favorable and cost-saving solution.

The object is solved by the characteristics of the independent patent claim 1. Advantageous designs of the invention are specified in the sub-claims. It should be noted that the exemplary embodiments described hereafter are not restrictive, and there is the possibility of variations in the characteristics described in the description and sub-claims.

According to claim 1, the object of the invention is solved by providing a closing device for a motor vehicle, with a locking mechanism consisting of a rotary latch and at least one pawl and a trigger lever, whereby the locking mechanism can be unlocked by means of the trigger lever, a means arranged on the closing device for blocking a movement of the trigger lever, whereby the movement can be blocked by an external load acting on the motor vehicle and the moving of the blocking means, and the means for blocking can be guided in the closing device in a movable manner. The inventive formation of a closing device now creates the possibility of providing a blocking means, which can be moved directly by the closing device itself and guided preferably longitudinally. The movable arrangement of the blocking means in the closing device ensures a safe interaction between the blocking means and the trigger lever. Due to the direct accommodation of the blocking means in the closing device in particular, whereby the blocking means can be guided in a movable manner into the closing device and thus stored, an exact alignment, that is, an interaction between the blocking means and trigger lever can also be ensured in the event of an accident.

Various locks and closing devices can be used as locks for a motor vehicle. The closing device can be used as a compact constructional unit, for example, in a lateral door, sliding door or in the vicinity of flaps, lids or covers. Furthermore, it is also conceivable that, for example, hood latches, auxiliary locks, such as those in transporters, can be executed with the crash safety device according to the invention.

The locking mechanism consists of a rotary latch and at least one pawl, whereby the rotary latch can be held in a locked position using the pawl. Two-stage locking mechanisms consisting of a pre-ratchet and a main ratchet are used, as are systems with one or two pawls. The movement of the rotary latch is blocked or locked in the ratchet positions by means of the pawl.

A trigger lever acts on the locking mechanism, whereby the trigger lever disengages one or more pawls from the catch, for example, by a swivel movement. Preferably, the trigger lever is swivelably stored in the motor vehicle lock and in a housing and/or a lock case of the motor vehicle lock or motor vehicle closing device. A movement of the trigger lever thus enables the locking mechanism to be converted from the locked position to an unlocked position.

The blocking means can be used to block the movement of the trigger lever. The blocking means is movable for this purpose, and is thus accommodated in such a movable manner in the closing device that a swivel movement of the trigger lever can be prevented. By preventing the movement of the trigger lever, the locking mechanism remains in the locked position. It is advantageous here that the blocking means interacts directly with the trigger lever. This is advantageous because both the inside actuating lever and outside actuating lever may move in the event of an accident. The trigger lever preferably interacts with the inside actuating lever and outside actuating lever. If the movement of the trigger lever is blocked, neither an actuation of the inside actuating lever nor of an outside actuating lever can lead to an unintentional opening of the closing device in the event of an accident.

In one embodiment of the invention, the blocking means can be held or guided in a lock plate of the closing device. A closing device usually includes a lock plate or lock case, which is made from sheet steel. The lock plate is used to store the locking mechanism and ensure sufficient stabilization of the closing device, even in the event of extreme loads. The holding or movable storage of the blocking means in the lock plate is advantageous in this respect, since the blocking means is accommodated in a stable guide, so that a safe guiding of the blocking means can be ensured, even in the event of an extreme load which occurs, for example, during accidents. This particularly enables an exact alignment of the blocking means on the trigger lever or the locking mechanism. The trigger lever can also be stored in the lock plate in an advantageous manner, so that a safe alignment between the blocking means and trigger lever can be ensured at all times.

There is a further embodiment of the invention if the blocking means can be moved at least so far into the closing device that a movement of the trigger lever can be prevented. The blocking means is moved in such a manner that the blocking means comes into direct contact with the trigger lever. The movement range of the blocking means and the arrangement or formation of the trigger lever are designed in an advantageous manner in such a way that the movement of the blocking means can block the trigger lever in its swivel movement. The trigger lever is thus fixed in the closing device, whereby movements of the exterior handle or the interior door handle cannot have an unlocking effect on the closing device. Due to the direct interaction between the blocking means and the trigger lever, a constructively favorable and compact embodiment of a blocking means can be provided, which also proves to be a cost-effective factor for the closing device.

In a further advantageous embodiment of the invention, the blocking means has a contour that corresponds to the trigger lever. The formation of cooperating, that is, interlocking contours on the blocking means and on the trigger lever can ensure a safe interaction on the one hand and, on the other hand, ensure additional engagement protection between the blocking means and trigger lever. Furthermore, the engagement path of the blocking means with respect to the trigger lever can also be optimized and shortened in an advantageous manner if, for example, the blocking means is formed in such a manner that a swivel movement of the trigger lever occurs along a contour of the blocking lever, so that a direct engagement in the trigger lever is enabled even by the slightest movement of the blocking means. The cooperating contours can support the engagement in an advantageous manner and ensure an additional safety device of the trigger lever. In particular, the formation of radii on the trigger lever and on the blocking means offers advantageous embodiment variants to enable a swivel movement of the trigger lever along the blocking means.

If the blocking means is at least partially formed in the form of a cylindrical pin, this results in a further embodiment variant of the invention. At least a partial formation of the blocking means as a cylindrical pin offers the advantageous option of a guide in the closing device. In particular, the accommodation in the lock plate can be provided in a constructively favorable manner by a bore. Furthermore, a cylindrical formation of at least the area in which the blocking means is accommodated in a guidable manner ensures a high degree of safety, since a tilting of the blocking means can be prevented. Furthermore, a cylindrical and thus symmetrical formation of the blocking means enables an advantageous and cost-effective producibility.

In a further embodiment of the invention, the blocking means can be mounted in a sealed manner on the closing device, and can be mounted especially by means of a seal ring. A sealing mounting of the blocking means on the closing device offers the advantage that the blocking means can also be arranged in the wet area, for example, of a motor vehicle door. A wet area is the area that can be exposed to moisture due to environmental influences such as rain and/or splashing water. If the blocking means is executed with a seal, and executed in an advantageous embodiment with a seal enclosing the blocking means, the use of the closing device is also possible in areas in which the closing device may be exposed to dust or moisture.

A further embodiment of the invention can be provided if the blocking means is at least partially provided with an adapter, preferably on a side opposite an external load. The blocking means is accommodated in the closing device in a movable or longitudinally movable manner. In this case, the blocking means is aligned in such a manner in the closing device that the blocking means can be activated or moved by a deformation of the outer geometry of the motor vehicle, and preferably an outer panel of the motor vehicle. If, for example, an external load is exerted on a lateral door of the motor vehicle due to an accident, the outer skin deforms, that is, the sheet metal of the motor vehicle, and a load is exerted on the blocking means. Here, the blocking means is arranged in such a manner in the direction of the outer sheet metal of the door, for example, that the deformation initiates a movement of the blocking means. An adapter can be provided on the blocking means in an advantageous manner, which can be designed to adapt, for example, to the geometry of the body panel. Furthermore, an adapter can have an approximately round shape, for example, so that a force effect on the adapter in the direction of a linear motion of the blocking means can be deflected. The adapter is thus used as a force initiating means and for adapting to the installation situation of the closing device.

In a further embodiment variant of the invention, a lock housing is provided, whereby the lock housing has at least one contact surface which interacts with the blocking means. The blocking means can be guided in the lock case and/or in the lock housing and/or the lock lid. In order to prevent an unintentional movement of the blocking means and/or, for example, an actuation of the blocking means during mounting, a contact surface can be provided for the blocking means according to the invention, so that the blocking means can be positioned in its unactuated position. Furthermore, the contact surface can also serve as a mounting aid for the blocking means.

If the contact surface has at least one predetermined breaking point and if the blocking means interacts in such a manner with the contact surface in the event of an external load that the blocking means exceeds the predetermined breaking point, this results in a further advantageous embodiment of the invention. A predetermined breaking point can serve to detect an actuation of the blocking means. Furthermore, the contact surface in combination with the predetermined breaking point can define a resistance so that the triggering forces can be determined for the blocking means. The contact surface is preferably provided by the lock housing and/or the lock lid. The contact surface can be formed, for example, in one piece with the lock housing and/or the lock lid, both of which are preferably made of plastic. The predetermined breaking point can be provided, for example, by a material tapering and/or, for example, by a perforation.

There is a further advantageous embodiment of the invention if the blocking means can be positioned via a spring element. A spring element is used to position or hold the blocking means in its initial position, that is, its unactuated position. Two German terms are used as synonyms for the single English term "blocking means" in the context of the invention. A compression spring in the form of a coil spring and/or a spring sheet, for example, can be used as a spring element. The spring element positions the blocking means in such a manner that the blocking means is held in an extended position, that is, a position in which the blocking means is not yet actuated, as in not engaged with the trigger lever.

If the spring can be attached to the housing and/or the lock plate, this results in a further embodiment variant of the invention. A positioning of the spring element in the area of the lock housing and/or the lock plate offers the advantage that the spring element can be subsequently mounted, for example, that is, with an already closed lock. Preferably, the spring element can be formed in the form of a leaf spring and can be inserted into the lock housing and come into contact with the lock plate.

The embodiment of the spring in the form of a leaf spring enables a constructively favorable and cost-effective embodiment variant of a positioning device for the blocking means.

If the blocking means has at least one ring nut and if the spring element can be inserted into the ring nut, this results in a further embodiment variant of the invention. If, for example, the leaf spring is formed in such a form that the leaf spring or the spring element can be inserted into the housing and the blocking means, this results in a constructively favorable embodiment variant of the invention. Here, the blocking means can be easily and safely positioned with respect to the closing device. Furthermore, the leaf spring offers the possibility of stable and durable bearing protection for the blocking means.

The invention is described in further detail below with reference to the attached drawings on the basis of an exemplary embodiment. However, the principle applies that the exemplary embodiment does not limit the invention, but only constitutes an advantageous embodiment. The illustrated characteristics can be executed individually or in combination with further characteristics of the description, as can the patent claims be executed individually or in combination.

Figure 2:
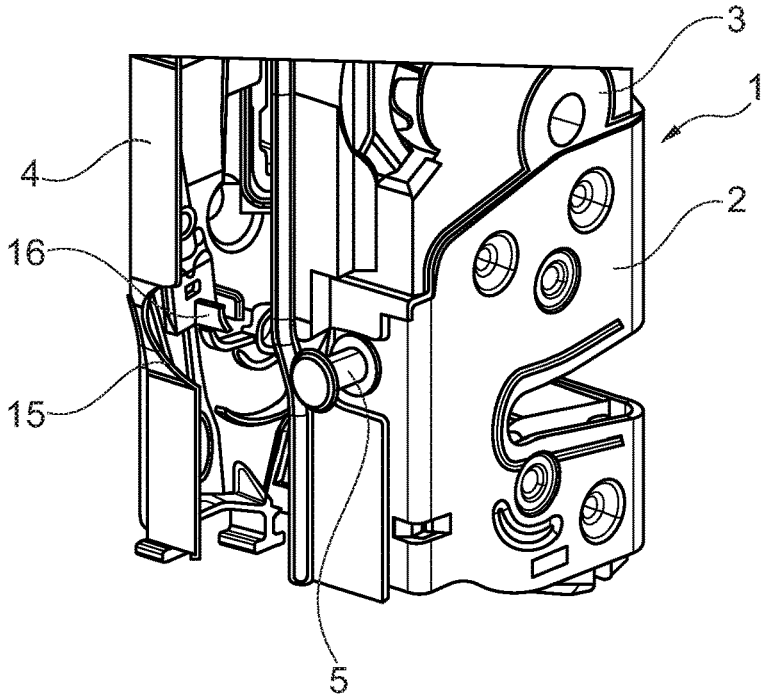
Figure 3:
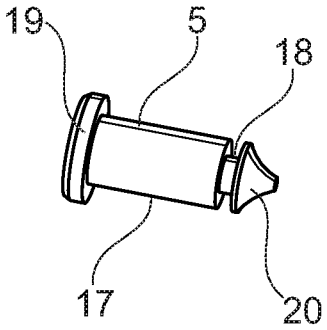
Figure 4:
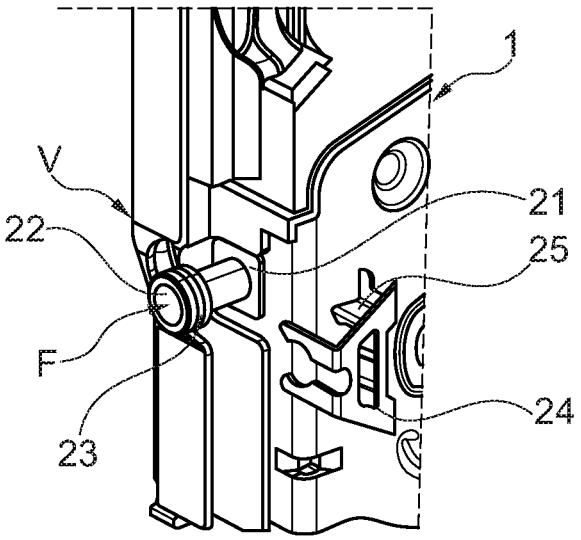
Figure 5:
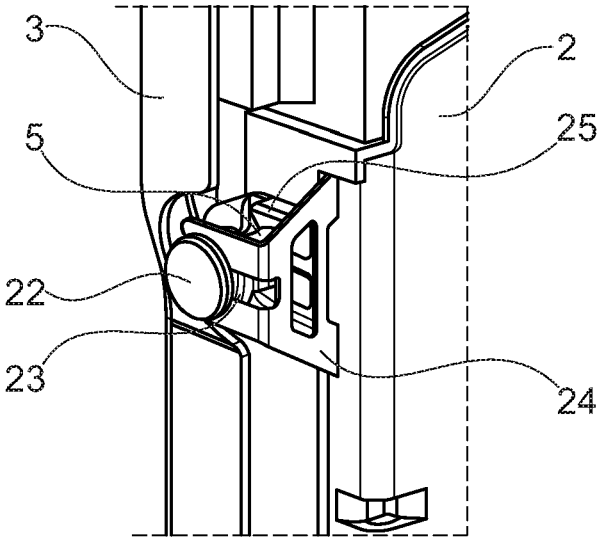

The following are shown:

FIG. 1 a three-dimensional view of a closing device and, particularly of the lock plate with a blocking means in an initial position, FIG. 2 a further three-dimensional view of a closing device, whereby the lock lid for illustrating the contact surface for the blocking means is reproduced at a distance from the lock housing, FIG. 3 a blocking means, FIG. 4 a three-dimensional view of a blocking means in a closing device with a spring element detached from the blocking means, and FIG. 5 a view of a closing device with a blocking means and a mounted spring element for positioning the blocking means.

A three-dimensional view of a motor vehicle lock or a closing device 1 is reproduced in FIG. 1. The closing device 1 has a lock plate 2, a lock housing 3, a lock lid 4, and a blocking means 5. The closing device 1 is reproduced by the side of the lock plate 2, so that the infeed section 6 is recognizable with the rotary latch arranged in the infeed section 6. The lock plate 2 still supports the bearing axes 8, 9 for the locking mechanism 7. The lock plate 2 is still used as the accommodation for the blocking means 5.

The lock plate 2 also has thread 10, by means of which the closing device 1 can be mounted on, for example, a motor vehicle door. In this embodiment, the lock plate 2 partially encloses the lock housing 3, whereby the lock plate 2 is simultaneously enclosed by the lock housing 3. In the area of the blocking means 5, the lock housing 3 has a recess 11, so that the blocking means 5 can be guided directly through the lock plate 2. A seal ring 12 encloses a cylindrical area of the blocking means 5 and seals the blocking means 5 against the closing device 1.

The blocking means 5 also has an adapter 13, with which the blocking means 5 can interact with, for example, a door skin of a motor vehicle.

FIG. 1 also shows an additional guide means 14, with which the lock 1 can be mounted or other components can be adapted to the lock 1.

In FIG. 2, the closing device 1 is reproduced in a three-dimensional view, whereby the lock lid 4 is reproduced as detached from the closing device 1. It is evident that the lock lid 4 has an opening 15 through which the blocking means 5 can be at least partially guided. It is evident that the area of the opening 15 has a contact surface 16, which is formed as part of the lock lid 4. The contact surface 16 can be provided with a predetermined breaking point, which can be formed in one piece with the contact surface 16 and the lock lid 4. The blocking means 5 is alternatively reproduced without an adapter 13, whereby the blocking means 5 can be positioned, for example, by a compression spring arranged inside the closing device 1.

If an external load F is applied to the closing device 1, the blocking means 5 is moved into the closing device 1 and engages with a trigger lever. In this case, the blocking means 5 is guided in a longitudinally movable manner by means of the lock plate 2 and the lock housing 3, as well as guided at least partially by the lock lid 4. The movement of the blocking means 5 also requires the contact surface 16 to be moved or detached from the lock lid 4.

In FIG. 3, a blocking means 5 is reproduced in the form of a cylindrical pin 17. The blocking means 5 has a ring nut 18, as well as a cylindrical bulge 19, whereby the cylindrical bulge 19 can be used, for example, as a contact surface for a leaf spring. The ring nut 18 in turn can be introduced into the contact surface, for example, so that a form fit can be produced between the blocking means 5 and the contact surface 16.

It is evident at the same time that the blocking means 5 has a pointed contour 20, so that a corresponding contour 20 can be produced between the blocking means 5 and the trigger lever.

In FIG. 4, a three-dimensional view of a closing device 1 is reproduced, whereby a seal ring 21 is square-shaped in this embodiment. The cylindrical bulge 22 has a ring nut 23 into which a spring element 24 can be inserted.

In FIG. 5, an enlarged illustration of the V area from FIG. 4 is reproduced, whereby the spring element 24 is reproduced in a mounted position and engaged with the blocking means 5. The spring element 24 is designed as a leaf spring and engages in the ring nut 23 of the cylindrical bulge 22. Another spring leg 25 encloses the blocking means on the one hand and is fixed between the lock housing 3 and the lock plate 2. The spring element 24 can be used to position the blocking means. Furthermore, a combination of a spring element 24 and a contact surface 16 can be advantageous in preventing an unintentional actuation of the blocking means 5. Due to the inventive formation of the blocking means 5, it is now possible to ensure the safe blocking of a trigger lever in a closing device and to create a constructively favorable and cost-effective way of ensuring the safety of the occupants of a motor vehicle.

LIST OF REFERENCE NUMERALS

1 closing device, lock
2 Lock plate
3 Lock housing
4 Lock lid
5 Blocking means
6 Infeed section
7 Catch
8, 9 Bearing axis
10 Thread
11 Recess
12, 21 Seal ring
13 Adapter
14 Guiding element
15 Opening
16 Contact surface
17 Cylindrical pin
18, 23 Ring nut
19, 22 Cylindrical bulge,
20 pointed contour,
24 spring element,
25 spring leg
F Load

The invention claimed is:

1. A closing device for a motor vehicle, the closing device comprising:

a locking mechanism having a rotary latch, at least one pawl, and a trigger lever, whereby the locking mechanism can be unlocked by the trigger lever, a contact surface with a predetermined breaking point, a blocking component arranged on the closing device for blocking a movement of the trigger lever when an external load acts on the motor vehicle, wherein the blocking component is guided in a movable manner into the closing device and interacts with the contact surface, wherein the contact surface is arranged between the blocking means and the trigger lever, wherein, in the event of the external load exceeding the predetermined breaking point, the blocking component breaks the contact surface and the blocking component interacts with the trigger lever to block the movement of the trigger lever such that the locking mechanism remains in the locked position.

2. The closing device according to claim 1, wherein the blocking component is held in a lock plate.

3. The closing device according to claim 1, wherein the blocking component is moved at least so far into the closing device to directly contact the trigger lever.

4. The closing device according to claim 1, wherein the blocking component has a contour that corresponds to the trigger lever.

5. The closing device according to claim 1, wherein the blocking component includes a cylindrical pin.

6. The closing device according to claim 1, wherein the blocking component is mounted in a sealed manner to the closing device.

7. The closing device according to claim 1, wherein the blocking component includes an adapter.

8. The closing device according to claim 1, wherein a lock housing is provided and the lock housing has the at least one contact surface which interacts with the blocking component.

9. The closing device according to claim 1, wherein the blocking component is positioned by a spring element.

10. The closing device according to claim 9, wherein the spring element is attached to a housing and/or to a lock plate and/or to a lock lid.

11. The closing device according to claim 9, wherein the blocking component has at least one ring notch and the spring element is inserted in the ring notch.

12. The closing device according to claim 6 further comprising a seal ring by which the blocking component is mounted.

13. The closing device according to claim 7, wherein the adapter has a round shape to deflect a force on the adapter that occurs in a direction of linear motion of the blocking component.

14. The closing device according to claim 1, wherein the predetermined breaking point is defined by a material tapering or perforation of the contact surface.

15. The closing device according to claim 4, wherein the blocking component is formed of a cylindrical pin having a cylindrical bulge on one end thereof and the contour on an opposite end thereof.

16. The closing device according to claim 15, wherein the blocking component has a ring nut arranged between the contour and the cylindrical pin.

17. The closing device according to claim 16, wherein the ring nut receives a spring element.

18. The closing device according to claim 15, wherein the contour is pointed in a direction away from the cylindrical pin.

19. The closing device according to claim 9, wherein the spring element is a leaf spring.

* * * * *